US005623778A

United States Patent [19]

Dunn

[11] Patent Number: 5,623,778

[45] Date of Patent: Apr. 29, 1997

[54] WEATHERIZED POSTING BOARD ASSEMBLY

[76] Inventor: Gary D. Dunn, 2368 Podocarpus Way, Clearwater, Fla. 34619

[21] Appl. No.: 492,935

[22] Filed: Jun. 21, 1995

[51] Int. Cl.[6] ..... G09F 7/02

[52] U.S. Cl. ..... 40/611; 40/574

[58] Field of Search ..... 40/611, 574, 607

[56] References Cited

U.S. PATENT DOCUMENTS

| | | | |
|---|---|---|---|
| 923,335 | 6/1909 | Cornelius | 40/611 |
| 3,341,959 | 9/1967 | Sabadics | 40/607 |
| 3,552,702 | 1/1971 | Springer | 40/607 X |
| 3,593,447 | 7/1971 | Winegarten | 40/574 X |
| 3,793,756 | 2/1974 | Kay et al. | 40/611 X |
| 3,958,351 | 5/1976 | Summey | 40/607 |
| 4,232,467 | 11/1980 | Stewart | 40/607 |
| 5,457,905 | 10/1995 | Kaplan | 40/574 |

FOREIGN PATENT DOCUMENTS

| | | | |
|---|---|---|---|
| 2212316 | 7/1989 | United Kingdom | 40/574 |

*Primary Examiner*—Joanne Silbermann
*Attorney, Agent, or Firm*—Terrance L. Siemens

[57] ABSTRACT

A weatherized posting board assembly having a back frame and front cover of unitary construction, the interior surfaces of the back frame and front cover defining an enclosure within which documents or the like may be posted on a removable posting board. The front cover is hingedly attached to the back frame by a pair of hinge pins having a plurality of compressible ribs. The front cover includes a recess sized to receive a locking mechanism, the recess serving to inhibit tampering with the lock as well as protect the lock from the effects of the elements. The interior sidewalls of the back frame include a plurality of snap projections for releasable locking engagement with the edges of the posting board. A rectangular mounting brace projects from the rear exterior surface of the back frame generally adjacent to the perimeter of the rear surface. The mounting brace is adaptable for connection to either a post or any convenient vertical surface.

6 Claims, 3 Drawing Sheets

WEATHERIZED POSTING BOARD ASSEMBLY

BACKGROUND OF THE INVENTION

1. FIELD OF THE INVENTION

The present invention relates to a posting board for documents and the like. More specifically, it relates to a weatherized posting board which is adapted for outdoor use.

A posting board adaptable for outdoor use is particularly convenient for use at, e.g., a construction site where building plans, schedules, etc., need to be displayed outdoors. A posting board used in such an outdoor environment should be easily attachable to a post or the like in light of the fact that a convenient vertical surface may not be available. Such a posting board could be used at camping sites, playgrounds, or anywhere information must be displayed outdoors. This product is generally designed originally for Condo or Homeowner associations because it is required by statutes that notices be posted that are accessible at all times to residents which necessitates displaying outdoors many times although the product is usable for anyone in any situation indoors and outdoors.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. DESCRIPTION OF THE PRIOR ART

Devices for mounting documents and the like for display are old and well known in the art. Many such devices have been developed. The following known prior art has been directed to providing some examples of the state of the art for such devices. As will be seen, the simplicity and effectiveness of my invention is not rivaled in the prior art.

U.S. Pat. No. 4,821,440, issued to Dunn on Apr. 18, 1989, shows an inspection board assembly having an interior enclosure formed by a back frame having a flanged curl at each outer edge of its top and bottom sides. A four sided hinged cover engages flush with the bottom of each U-shaped curl to prevent water access to the interior of the assembly. A tack board is attached to an interior surface of the back frame, and the documents or other displays can be attached to the tack board, which is not replaceable. A couple of apertures are provided in the back frame so that screws or equivalent can be used to attach the assembly to a post or other surface. By contrast, the present invention contemplates a posting board assembly having a back frame of unitary construction and a totally transparent front cover, the back frame and front cover having interior surfaces defining an enclosure within which documents or the like may be posted on a removable posting board. The front cover is hingedly attached to the back frame by a pair of hinge pins having a plurality of annular ribs. The interior sidewalls of the back frame include a plurality of snap projections either formed into the receiving base or snap or spring retainers affixed to the receiving base which allow the tack unit to be easily installed and or replaced. Also the tack unit may be permanently affixed with any mechanical means. A rectangular mounting support member projects from the rear surface of the back frame and includes a plurality of raised portions having bores formed therein for receiving a corresponding plurality of nails or the like extending from a mounting surface. The mounting support member also includes a pair of vertically aligned recesses to facilitate mounting to a post or the like.

U.S. Pat. No. 4,337,590, issued to Jackson on Jul. 6, 1982, shows a reflective document container. A reflective member such as a mirror is permanently secured to an inner surface of the frame. A transparent document having indicia printed thereon is placed over the reflective member and held in place by closing a hinged transparent front cover. By contrast, the device of the instant invention has a removable posting board or surface for posting documents.

U.S. Pat. No. 4,333,253, issued to Cooper on Jun. 8, 1982, shows a frame for a display sign which, in one embodiment, includes a transparent front cover hingedly attached to a back member. The frame is apparently not weather resistant, does not include a removable posting board, and cannot be locked. By contrast, the device of the instant invention has a removable posting board and can be locked. The locking mechanism is mounted within a recess in the front cover, the recess serving to inhibit tampering as well as protect the locking mechanism from the elements.

U.S. Pat. No. 4,602,738, issued to Ball on Jul. 29, 1986, shows a document container designed for outdoor use. The document container does not allow for display of the documents but does have a window in the front cover so that users can determine if there are documents in the container. By contrast, the device of the instant invention allows for simultaneous display of multiple documents in a weatherized container.

None of the above inventions and patents, taken either singly or in combination, is seen to describe the instant invention as claimed.

SUMMARY OF THE INVENTION

Briefly, the invention comprises a weatherized posting board assembly having a back frame and front cover of unitary construction, the interior surfaces of the back frame and front cover defining an enclosure within which documents or the like may be posted on a removable posting board. The front cover is hingedly attached to the back frame by a pair of hinge pins having a plurality of compressible ribs. The front cover includes a recess sized to receive a locking mechanism, the recess serving to inhibit tampering with the lock as well as protect the lock from the effects of the elements. The interior sidewalls of the back frame include a plurality of snap projections either formed into the receiving base or snap or spring retainers affixed to the receiving base which allow the tack unit to be easily installed and or replaced. A rectangular mounting brace projects from the rear exterior surface of the back frame generally adjacent to the perimeter of the rear surface. The mounting brace is adaptable for connection to either a post or any convenient vertical surface.

Accordingly, it is a principal object of the invention to provide a new and improved weatherized posting board assembly which overcomes the disadvantages of the prior art in a simple but effective manner.

It is a major object of this invention to provide a weatherized posting board assembly having an adaptable mounting brace which allows for connection to a post or to a vertical surface.

It is another object of the invention to provide a weatherized posting board assembly which has a removable posting board.

It is another object of the invention to provide a weatherized posting board assembly having a tamper resistant locking mechanism.

It is another object of the present invention to provide a weatherized posting board assembly which has a fully transparent cover.

It is another object of the invention to provide a weatherized posting board assembly which has a fully functional normally vertical hinge line for the transparent cover which is formed by the simple expedient of two hinge pins.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
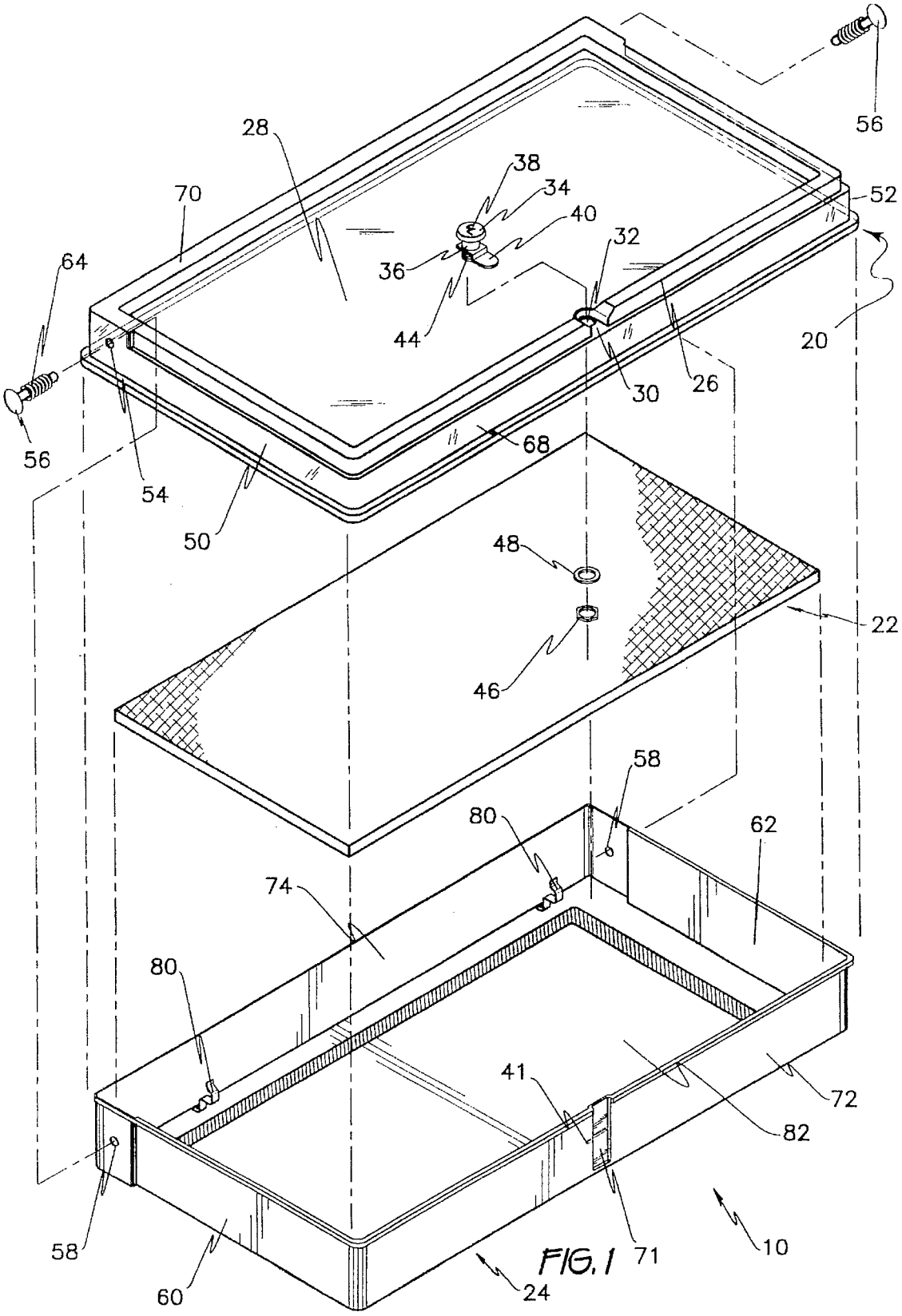
FIG. 1 is an exploded environmental perspective view of the first embodiment of the invention.

The weatherized posting board assembly of the present invention is generally designated by arrow 10 of FIG. 1. The invention 10 has three main parts; the front cover 20, the posting board 22, and the back frame 24.

Figure 2:
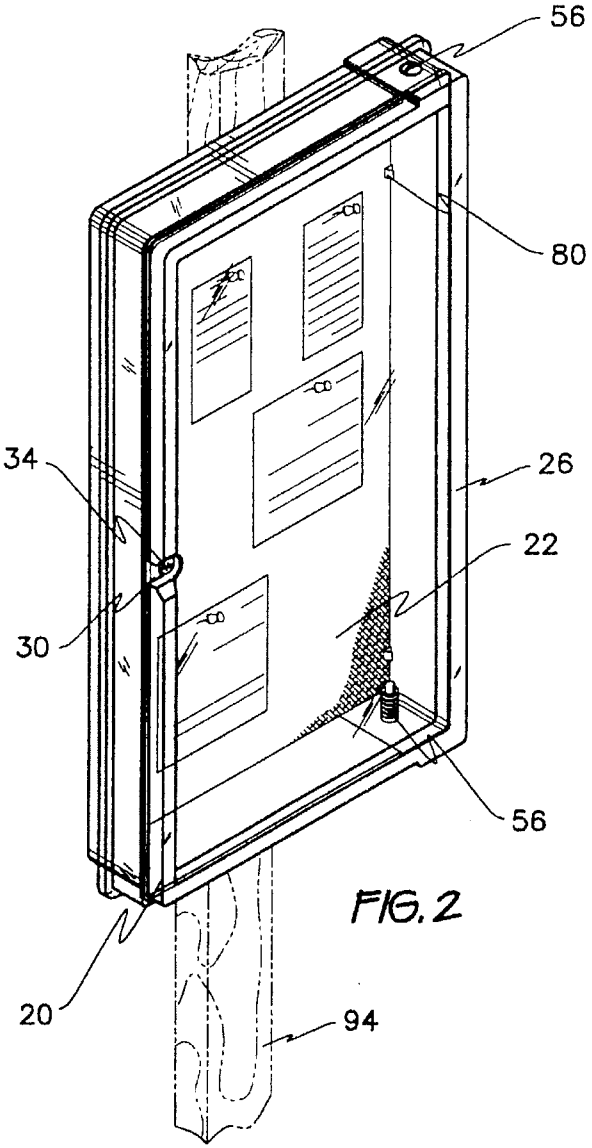
FIG. 2 is a perspective view of the invention mounted on a post.

Referring now to FIGS. 1 and 2, the front cover 20 is essentially rectangular in shape, transparent, and has a rib 26 protruding about the perimeter of the front exterior surface 28. The front cover 20 is preferably made of a rigid and transparent plastic material such as clear polycarbonite commonly sold under the trademark LEXAN®. The front cover 20 is preferably formed by vacuum molding, injection or a similar process. A recess 30 is formed in the rib 26 about an aperture 32. The aperture 32 is sized for insertion of a locking mechanism 34, the locking mechanism 34 having a barrel 36 with a keyhole 38. A latch 40 can be rotated into and out of engagement with a slot 41 cut in a recessed sidewall 71 of the back frame 24. The locking mechanism 34 has a threaded portion 44 or any means which secures a locking mechanism extending downwardly from the latch 40, the threaded portion 44 allowing for engagement with a nut 46 and corresponding washer 48 for securing the locking mechanism 34 to the front cover 20.

The recess 30 is provided to inhibit tampering with the locking mechanism 34 by limiting access thereto by a tool capable of prying, hammering or otherwise damaging the lock in an effort to gain unauthorized access. The recess 30 also reduces exposure of the locking mechanism 34 to the elements such as rain or snow.

The top and bottom sidewalls 50, 52 of the front cover 20 have apertures 54 formed therein for receiving hinge pins 56. A corresponding pair of apertures 58 is formed in the top and bottom sidewalls 60, 62 of the back frame 24. Thus a hinge assembly comprising axially aligned apertures 54 and 58 and hinge pins 56 allows for hingedly connecting the front cover 20 to the back frame 24. It can be seen that the hinge pins 56 have a plurality of annular ribs 64 which are compressible to allow for insertion of the hinge pins 56 into the aligned apertures 54 and 58 thereby enabling quick connection of the front cover 20 to the back frame 24.

The front cover 20 sidewalls 50, 52, 68, and 70 overlap the sidewalls 60, 62, 72, and 74 of the back frame 24 to provide a substantially weather resistant enclosure for documents which are posted on the posting board 22 as shown in FIG. 2. It should be noted that both the front cover 20 and the back frame are of unitary construction so that leakage through overlapping panels, seams, etc. can be avoided.

At least three different types of posting board 22 may be used in accordance with the present invention as will be explained later.

The back frame 24 is made of a rigid plastic and is also preferably formed using a vacuum molding technique or other suitable forming means. The interior surfaces of sidewalls 72, 74 have a plurality of integrally formed snap indents 80 either formed into the receiving base or snap or spring retainers extending therefrom. The snap indents 80 allow for releasable locking engagement of the posting board 22 to the rear interior surface 82 of the back frame 24. Alternatively, the snap indents 80 may be metal clips which are secured to the rear interior surface 82 by screws or other fasteners. Different types of clips can be interchangeably used to secure the posting board 22 to the rear interior surface 82.

The posting board 22 may be a fabric covered tack board or equivalent as shown in FIGS. 1 and 2. This type of board 22 is useful for posting documents, posters, or the like as is well known.

Figure 4:
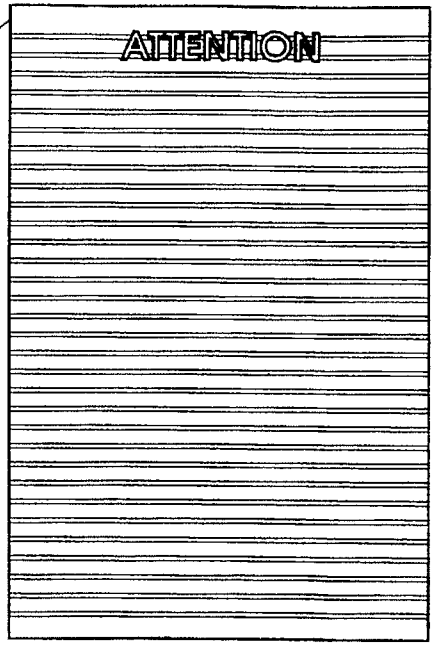
FIG. 4 is a plan view of a ruled posting board.
Figure 3:
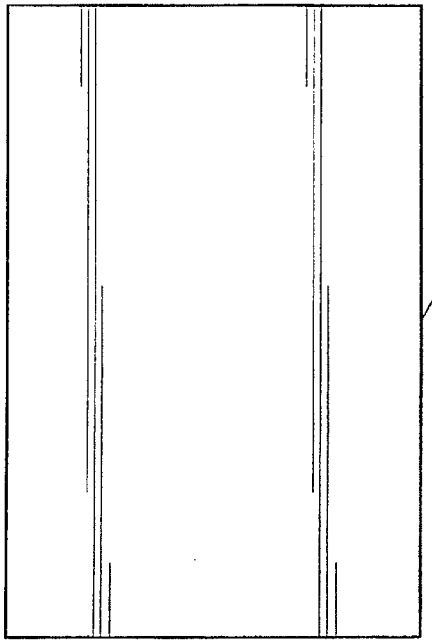
FIG. 3 is a plan view of a fabric covered posting board.

Referring now to FIGS. 3 and 4 two different types of boards 22' and 22" are shown. An erasable marking board 22' may be used in place of the posting board 22. A grease pencil or equivalent type of marking pen can be used to write on the board 22'. Alternatively, a ruled, covered posting board 22" may be used as is shown in FIG. 4. This type of board 22" can be used with high contrast lettering to changeably display the desired information. The snap indents 80 permit the user to quickly and easily interchange the posting boards 22, 22', and 22" without using any tools.

Figure 5:
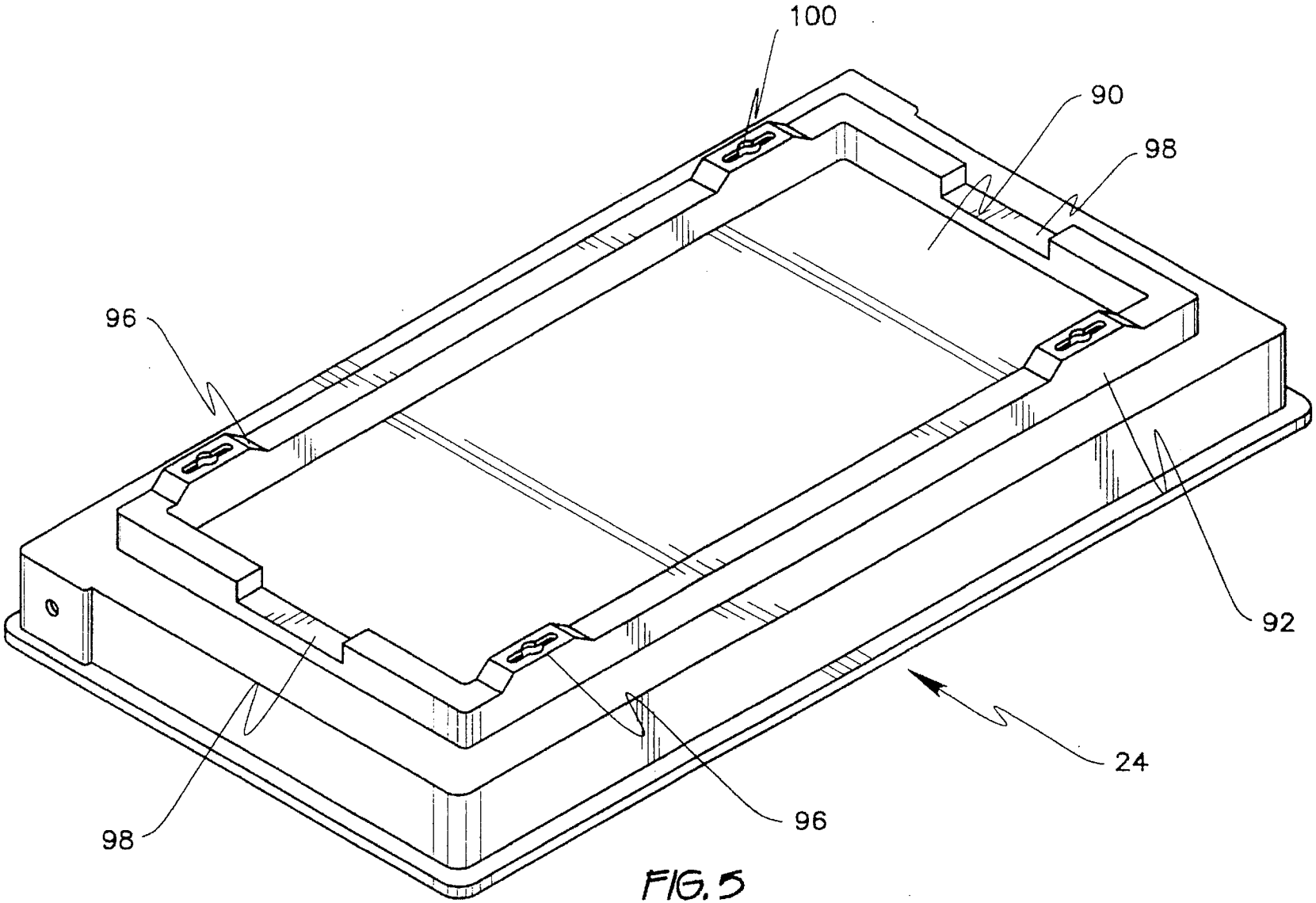
FIG. 5 is a rear view of the back frame of the posting board assembly.

The exterior of the back frame 24 is shown in the perspective view of FIG. 5. The exterior rear surface 90 of the back frame has a rectangular mounting support or brace 92 which allows for easy connection of the assembly 10 to either a flat surface such as a wall or a post 94 as shown in FIG. 2. The brace 92 is parallel to the perimeter of the exterior rear surface 90 and includes a plurality of raised portions 96 and a pair of recesses 98. The raised portions 96 may have keyhole slots 100 formed therein. The keyhole slots 100 allow for insertion of a connector such as a nail or screw (not shown) having a head with a relatively large diameter as is known in the art. Thus the plurality of raised portions 96 with keyhole slots 100 can be connected to a corresponding plurality of nails or other connectors extending from a wall or other flat surface thereby securing the assembly 10 to the wall. Alternatively, the back frame 24 can be secured to a post 94. This feature is convenient when, for example, at a construction site where there are no structures upon which to mount the assembly 10. Recesses 98 are shaped so that a post 94 may be at least partially seated therewithin thereby assuring that the assembly 10 is properly oriented with respect to the post 94. Additionally, the recesses 98 help to stabilize the assembly 10 upon the post 94. If desired, apertures can be formed in the recesses 98 to allow for connectors such as screws or nails to pass therethrough.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily form a recess in the rear interior surface 82 of the back frame 24 so that the posting board 22 can be seated therein.

It is to be understood that the present invention is not limited to the sole embodiment described above, but encompasses any and all embodiments within the scope of the following claims:

I claim:

1. A weatherized posting board assembly comprising:

a back frame enclosure having two side members, a top member and a bottom member, all integral at an interior edge with a back member, said back member having interior and exterior surfaces and a rectangular perimeter;

said back member exterior surface having a monolithic raised rectangular mounting brace means projecting rearwardly therefrom, said rectangular mounting brace means adaptable for connection to at least two different vertical supports;

a posting board mounted on said interior surface of said back member;

a front cover hinged to said back frame enclosure, said front cover having two side members, a top member and a bottom member, all integral at an interior edge with a transparent front panel, said two side, top, and bottom members of said front cover corresponding to said two side, top, and bottom members of the back frame enclosure, the front cover pivotal between open and closed positions, said two side, top, and bottom members of the front cover overlapping said two side, top, and bottom members of the back frame enclosure when said front cover is in the closed position, wherein the overlapping of said two side, top, and bottom members provides a substantially watertight enclosure for documents posted on said posting board.

2. The weatherized posting board assembly of claim 1 wherein, said posting board is releasable and lockable to said interior surface of said back member.

3. The weatherized posting board assembly of claim 1 wherein, said rectangular mounting brace means has a pair of axially aligned recesses on opposite sides, said aligned recesses sized to allow a post to be at least partially seated therein.

4. The weatherized posting board assembly of claim 1 wherein, said rectangular mounting brace means has a plurality of raised portions protruding rearwardly therefrom, said raised portions having keyhole slots formed therein thereby allowing connection of said rectangular mounting brace means to a corresponding plurality of connectors extending from a vertically extending surface.

5. The weatherized posting board assembly of claim 1 wherein, said entire front cover, including said two side, top, and bottom members, is made of a transparent material.

6. The weatherized posting board assembly of claim 1 wherein, said front cover has a locking mechanism secured thereto for locking said front cover to said back frame enclosure in said closed position thus providing security for documents posted on said posting board.

* * * * *